US010267335B1

(12) United States Patent
Freakes

(10) Patent No.: US 10,267,335 B1
(45) Date of Patent: Apr. 23, 2019

(54) METHODS AND APPARATUS FOR MOUNTING AN IMPELLER WITH POSITIONAL REPEATABILITY

(71) Applicant: Anthony Freakes, Lawrenceville, NJ (US)

(72) Inventor: Anthony Freakes, Lawrenceville, NJ (US)

( * ) Notice: Subject to any disclaimer, the term of this patent is extended or adjusted under 35 U.S.C. 154(b) by 268 days.

(21) Appl. No.: 15/273,931

(22) Filed: Sep. 23, 2016

Related U.S. Application Data

(60) Provisional application No. 62/222,299, filed on Sep. 23, 2015.

(51) Int. Cl.

| | |
|---|---|
| ***F04D 29/04*** | (2006.01) |
| ***F04D 29/20*** | (2006.01) |
| ***F04D 29/05*** | (2006.01) |
| ***F04D 29/62*** | (2006.01) |
| ***F04D 29/043*** | (2006.01) |
| ***F04D 29/053*** | (2006.01) |
| ***F04D 29/22*** | (2006.01) |
| ***F04D 29/28*** | (2006.01) |

(52) U.S. Cl.
CPC ..... *F04D 29/624* (2013.01); *F04D 29/043* (2013.01); *F04D 29/053* (2013.01); *F04D 29/22* (2013.01); *F04D 29/28* (2013.01); *F04D 29/628* (2013.01)

(58) Field of Classification Search
CPC ..... F04D 29/043; F04D 29/053; F04D 29/22; F04D 29/28; F04D 29/624; F04D 29/628
See application file for complete search history.

(56) References Cited

U.S. PATENT DOCUMENTS

| | | | | |
|---|---|---|---|---|
| 2,577,134 A * | 12/1951 | Land | F01D 5/025 403/298 |
| 2,602,683 A * | 7/1952 | Aue | F01D 5/025 403/259 |
| 2,836,448 A | 5/1958 | King | |
| 3,500,660 A | 3/1970 | Anderson | |
| 3,601,501 A * | 8/1971 | Johnson | F01D 5/025 416/244 R |
| 4,032,256 A * | 6/1977 | Tatkov | F04D 1/06 415/198.1 |

(Continued)

FOREIGN PATENT DOCUMENTS

| | | |
|---|---|---|
| JP | 08101089 A | 4/1996 |
| JP | 2000081360 A | 3/2000 |

(Continued)

*Primary Examiner* — Igor Kershteyn
(74) *Attorney, Agent, or Firm* — Timothy X. Gibson; Gibson & Dernier LLP

(57) ABSTRACT

A flange for centering an impeller on a motor shaft includes a central bore for receiving a motor shaft, an impeller facing end and a motor bearing facing end formed opposite the impeller facing end, wherein the impeller facing end includes at least one impeller engaging element configured to couple with a flange facing side of the impeller, wherein the flange facing side of the impeller includes at least one flange engaging element complementary to the at least one impeller engaging element of the flange. An assembly including the motor shaft an impeller is disclosed, as well as centering elements for use in repeatably mounting the assembly to an impeller. Methods of determining optimal balance are disclosed.

14 Claims, 11 Drawing Sheets

(56) References Cited

U.S. PATENT DOCUMENTS

| | | | | |
|---|---|---|---|---|
| 4,074,946 | A | 2/1978 | Swearingen | |
| 4,257,744 | A * | 3/1981 | Watson | F04D 29/266 403/282 |
| 4,934,138 | A * | 6/1990 | Boyd | F01D 5/025 416/241 B |
| 4,978,080 | A | 12/1990 | Weitekamp | |
| 5,791,803 | A | 8/1998 | Nordquist | |
| 6,065,898 | A | 5/2000 | Hale | |
| 6,254,349 | B1 * | 7/2001 | Haugen | F04D 29/266 415/216.1 |
| 6,499,958 | B2 * | 12/2002 | Haugen | F04D 29/266 416/204 A |
| 7,083,521 | B2 | 8/2006 | Takei | |
| 7,527,479 | B2 * | 5/2009 | Shi | F01D 5/025 416/241 A |
| 8,429,968 | B2 | 4/2013 | Allen, IV | |
| 8,539,831 | B2 | 9/2013 | Allen, IV | |
| 8,628,269 | B2 | 1/2014 | Fan | |
| 9,371,835 | B2 * | 6/2016 | Stanko | F01D 21/045 |
| 2003/0022720 | A1 | 1/2003 | Takei | |
| 2003/0086748 | A1 | 5/2003 | Culpepper | |
| 2005/0188765 | A1 | 9/2005 | Care | |
| 2005/0235750 | A1 | 10/2005 | Franz | |
| 2013/0333468 | A1 | 12/2013 | Leveille, IV | |

FOREIGN PATENT DOCUMENTS

| | | | |
|---|---|---|---|
| JP | 2000234980 | A | 8/2000 |
| JP | 2003042179 | A | 2/2003 |
| JP | 2006275715 | A | 10/2006 |
| SU | 1259122 | A1 | 9/1986 |

* cited by examiner

METHODS AND APPARATUS FOR MOUNTING AN IMPELLER WITH POSITIONAL REPEATABILITY

CROSS-REFERENCE TO RELATED APPLICATIONS

This non provisional application claims the benefit of U.S. Provisional Patent Application No. 62/222,299 filed Sep. 23, 2015, the entirety of which is incorporated herein by reference.

FIELD OF THE INVENTION

The invention relates to impellers and in particular to devices and methods for mounting impellers on a motor shaft.

BACKGROUND

Many commercially available products such as leaf blowers, blenders, etc. use small motors having an impeller mounted to a rotor. Vibration in such devices can be unpleasant, and in some cases, cause injury to the operator or damage to the device itself when excessive. The vibration in such devices arises principally from rotational imbalance in the impeller assembly. For example, as a rotating assembly revolves at a high speed, such as 15,000 rpm, any imbalance above about 0.6 gram inches causes unpleasant vibration.

SUMMARY OF THE INVENTION

The prior art of mounting impellers to motor shafts uses two flats machined into the motor shaft to provide rotation prevention of the impeller relative to the motor shaft. This is done for two reasons. One is to impart full motor torque, and the other possibly more important reason is to prevent the retaining nut from loosening when the impeller is abruptly stopped, or when the motor torque accelerates the impeller from rest to full speed.

An insurmountable difficulty comes with this method. The female hole in the impeller assembly must have sufficient clearance to permit assembly. This clearance may be as much as 0.004". When this is combined in diameter and flat, it allows a 0.0033" possible shift of the impeller axis relative to the motor shaft axis. This allowance makes accurate repeatability of the position of the assembled impeller impossible. Even if the original assembly of the impeller to motor shaft is carefully balanced, the first time the impeller must be loosened for cleaning or other reasons, the original position is not repeatable and the original imbalance attainment is lost. In addition, the removal of material when milling the flats renders the shaft weaker and liable to stress relieving creep, which can further disturb the centralization and straightness of the shaft. This further widens the centroid to turning axis deviation. The amount of eccentricity which is evident when a 170 gram impeller is confined to a 0.4 gram inch imbalance tolerance happens to be 0.0023", so it can be seen that achieving and keeping the specified imbalance is impossible with the current art, which is in widespread use and therefore also makes unpleasant vibration impossible to remove.

In accordance with one or more embodiments a flange for centering an impeller on a motor shaft is disclosed, wherein the flange includes a central bore for receiving a motor shaft, an impeller facing end and a motor bearing facing end formed opposite the impeller facing end, wherein the impeller facing end includes at least one impeller engaging element configured to couple with a flange facing side of the impeller, wherein the flange facing side of the impeller includes at least one flange engaging element complementary to the at least one impeller engaging element of the flange.

The at least one impeller engaging element may include at least two tongues configured to couple with corresponding complementary grooves formed on a flange facing end of an impeller hub. In some embodiments, the flange includes at least one tongue which is an x-axis defining tongue and at least one tongue which is a y-axis defining tongue. In other embodiments the at least one impeller engaging element includes at least two grooves configured to couple with corresponding complementary tongues formed on a flange facing end of an impeller hub. In such embodiments one of the at least two grooves includes an x-axis defining groove and at least one of the at least two grooves includes a y-axis defining groove. The respective tongues and grooves defining the x-axis and the y-axis are arranged at 90° to each other, and are positioned to not disturb the coincidence of the center of gravity with the turning axis.

It will be apparent to the skilled artisan that the grooves may be formed on the flange, and the tongues may be formed on the impeller hub. In addition, the flange may include grooves and tongues, and the impeller likewise may include grooves and tongues.

When the impeller hub grooves (or tongues, depending on the embodiment) are brought into firm contact with the tongues (or grooves) of the flange, a repeatable assembly is provided. These structures enable a close to perfect alignment of the impeller center of gravity to the motor shaft turning axis at the flange location. This also allows the bore formed in the impeller hub to have ample clearance for easy assembly.

It will be recognized it is necessary to have a close alignment at the outer end of the mounting hole. This is achieved by arranging a close, tight fit for a small length.

An assembler would then feel easy movement, as the impeller is fitted onto the shaft, until the assembler feels a tightness after having properly aligned the grooves of the impeller hub with the tongues on the flange. This tightness, which will occur for the last about 0.050" of axial assembly, is easily overcome, when a retaining nut clamps the impeller tightly against the flange, and results in close to perfect repeatable balance.

In time the small length of close fit at the outer end of the mounting hole may become looser, due to operational forces and assembly and disassembly wear; however, the center of gravity is closer to the groove/tongue mounting and therefore any looseness in the outer mount has very little influence on balance.

Improved devices and methods of mounting and retaining an impeller on a motor shaft as disclosed herein achieve position repeatability within the aforementioned 0.0023" limit, while still being easy to assemble and disassemble. Impeller assemblies made in accordance with the present disclosure retain improved repeatability throughout the life of the device. The repeatability keeps the original level of vibration intact.

In some embodiments disclosed herein the need for flats to be machined into the motor shaft is eliminated. In accordance with other embodiments, the at least one impeller engaging element may include a plurality of legs extending from the impeller facing end of the flange, wherein each of the plurality of legs is configured to engage a cavity formed in the flange facing side of an impeller. A notch may be formed between each of the plurality of legs, wherein each of the notches is configured to accommodate a vane base extending from the flange facing side of the impeller. In accordance with other embodiments, the at least one impeller engaging element may be or include a flange centering element extending from the impeller facing side of the flange and positioned within a peripheral edge of the flange, wherein the flange centering element is configured to engage an impeller centering element positioned in a hub of the impeller, wherein the impeller centering element has a cross-section complementary to a cross-section of the flange centering element. The flange centering element may be positioned within a periphery formed by the legs. The flange centering element may be or include a frusto-conical protrusion configured to engage a complementary frusto-conical relief formed in a bore of an impeller hub.

The legs are configured to fit in the cavities in an impeller formed between bases of impeller vanes, and when engaged with the cavities, transmit torque from the motor shaft to the impeller, thus performing the duty, previously performed by the shaft flats, rendering the flats unnecessary. The notches between each of the legs to accommodate bases of impeller vanes.

The flange centering element may be positioned in the flange bore for centralizing the impeller centroid to the turning axis. The flange centering element is configured to mate with a corresponding complementary impeller centering element positioned or formed in (or by) the bore of the impeller hub. During assembly, at the same moment that the impeller hub engages with the flange protrusions, the flange centering element also is seated within the impeller hub centering element. The flange centering element has a taper, the axis of which exactly coincides with the cylindrical axis of the impeller so that when the impeller hub, with the matching female taper, is tightly assembled, the impeller assembly's centroid coincides with the motor turning axis.

The flange, which may have the features described above, is firmly attachable to the motor shaft. Secure placement of the flange on the motor shaft may for example be achieved by simple pinning, press fitting, gluing, etc. The flange may also be integral with the shaft.

Easy assembly, yet thorough alignment of the impeller hub bore and the motor shaft is achieved by only having a close fit of the bore of the impeller hub and the motor shaft at the end of the hub where the nut impinges against the hub face. During assembly, the fit is looser as the impeller is positioned and the fit becomes closer as the impeller nears its final assembled position, until the nut firmly tightens the impeller hub against the matched male and female taper joint. In time the small length of close fit at the outer end of the mounting hole may become looser, due to operational forces and assembly and disassembly wear; however, the taper is closer to the centroid of the impeller assembly and therefore any looseness in the outer mount has very little influence on balance.

In accordance with one or more embodiments, an assembly for centering an impeller on a motor shaft includes a motor shaft and a flange, wherein the flange is mounted on the motor shaft via a central bore formed in the flange, the flange including an impeller facing end and a motor bearing facing end formed opposite the impeller facing end, wherein the impeller facing end includes at least one impeller engaging element configured to couple with a flange facing end of an impeller, wherein the flange facing end of the impeller includes at least one flange engaging element complementary to the at least one impeller engaging element of the flange.

The at least one impeller engaging element may include at least two tongues configured to couple with corresponding complementary grooves formed on a flange facing end of an impeller hub. One of the at least two tongues may be an x-axis defining tongue and at least one of the at least two tongues may be a y-axis defining tongue. In other embodiments, the at least one impeller engaging element may include at least two grooves configured to couple with corresponding complementary tongues formed on a flange facing end of an impeller hub. One of the at least two grooves may be an x-axis defining groove and at least one of the at least two grooves may be a y-axis defining groove.

The impeller assembly impeller engaging element may include a plurality of legs extending from the impeller facing end, wherein each of the plurality of legs is configured to engage a cavity formed in the flange facing side of an impeller. A notch may be formed between each of the plurality of legs, wherein each of the notches is configured to accommodate a vane base extending from the flange facing side of the impeller.

In other embodiments the impeller assembly impeller engaging element includes a flange centering element extending from the impeller facing side of the flange and positioned within a peripheral edge of the flange, wherein the flange centering element is configured to engage an impeller centering element positioned in a hub of the impeller, wherein the impeller centering element has a cross-section complementary to a cross-section of the flange centering element. The flange centering element may be or include a frusto-conical protrusion and the impeller centering element may be or include a frusto-conical relief formed or positioned in a bore of an impeller hub.

Methods are also disclosed for determining the best position of the assembly relative to the impeller.

BRIEF DESCRIPTION OF THE DRAWINGS

For the purposes of illustration, there are forms shown in the drawings that are presently preferred, it being understood, however, that the invention is not limited to the precise arrangements and instrumentalities shown.

DETAILED DESCRIPTION OF THE INVENTION

Figure 1:
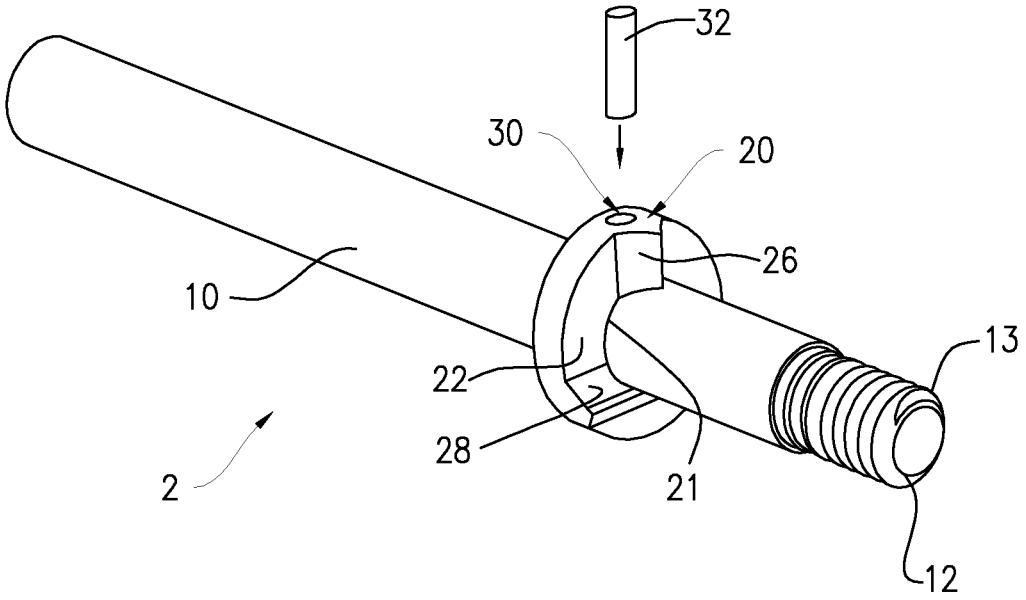
FIG. 1 is a perspective view of a motor shaft having a flange fixed thereto in accordance with one or more embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Although the devices and systems of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention.

Figure 1A:
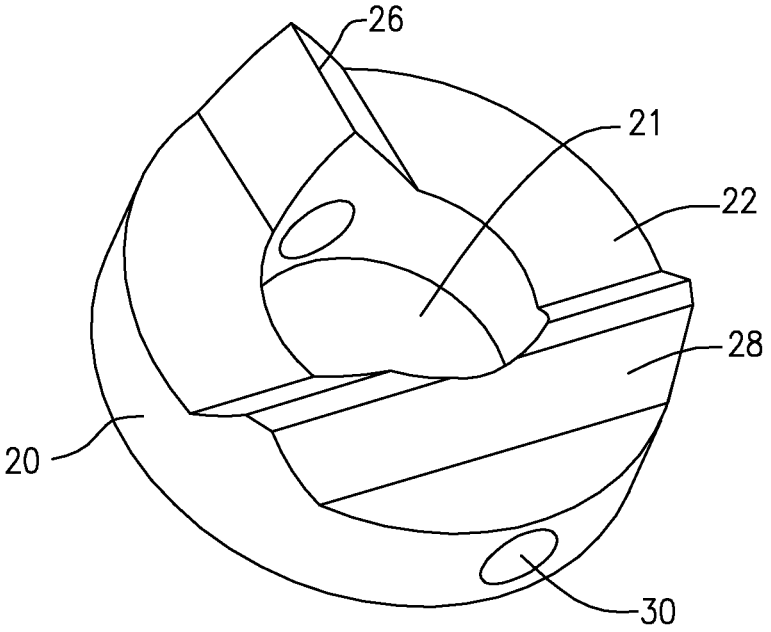
FIG. 1A is a perspective view of the flange of FIG. 1.

Referring to FIG. 1, an impeller mounting assembly 2 includes a motor shaft 10 and a flange 20 having a central bore 21 coupled to the motor shaft 10. With further reference to FIG. 1A, the flange 20 includes an x-axis defining tongue 26 and a y-axis defining tongue 28 formed on an impeller facing end 22. The tongues 26 and 28 each may have any suitable cross-sectional shape, such as a V-shape, U-shape, etc. The flange 20 may be fixed to the motor shaft 10 by any suitable means such as but not limited to a press fit, retaining pin, screw, gluing, etc. In one embodiment the flange includes an aperture 30 for receiving a fastener 32, which in the exemplary embodiment is a pin. The flange 20 may be integral with the motor shaft 10. The flange 20 is oriented on the motor shaft 10 so that the tongues 26, 28 face an impeller to be mounted on the shaft. The motor shaft 10 includes an impeller mounting end 12 and threads 13 for receiving a nut to secure the impeller to the shaft.

Figure 2:
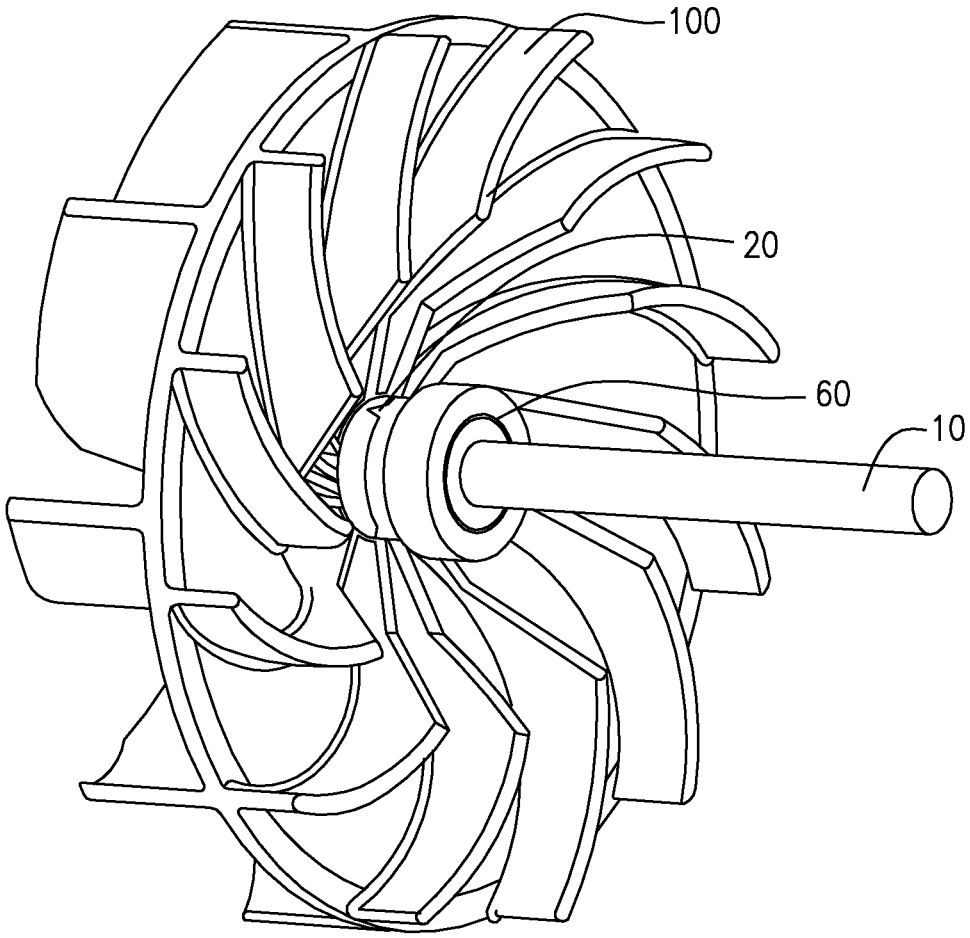
FIG. 2 is a perspective view of an impeller and motor shaft in accordance with one or more embodiments of the present invention.
Figure 3:
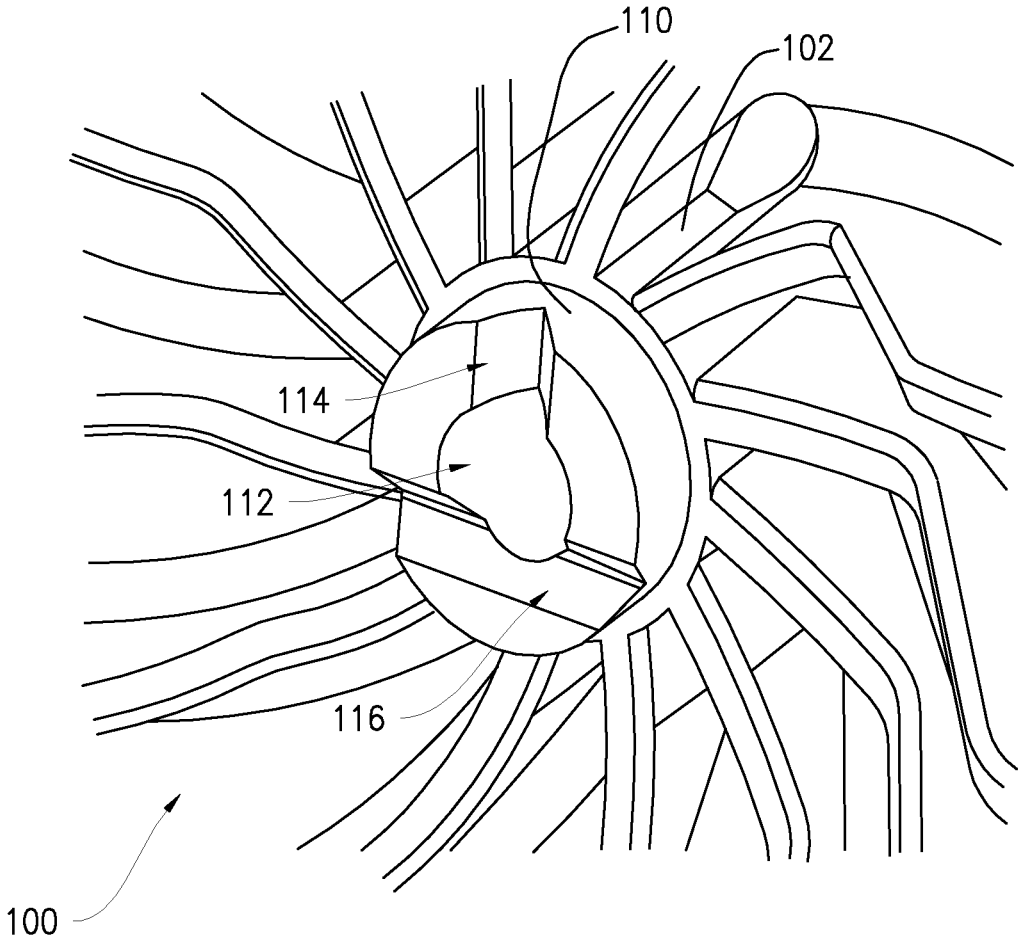
FIG. 3 is a perspective view of a portion of an impeller with grooves formed in the face of the impeller hub in accordance with one or more embodiments of the present invention.
Figure 4:
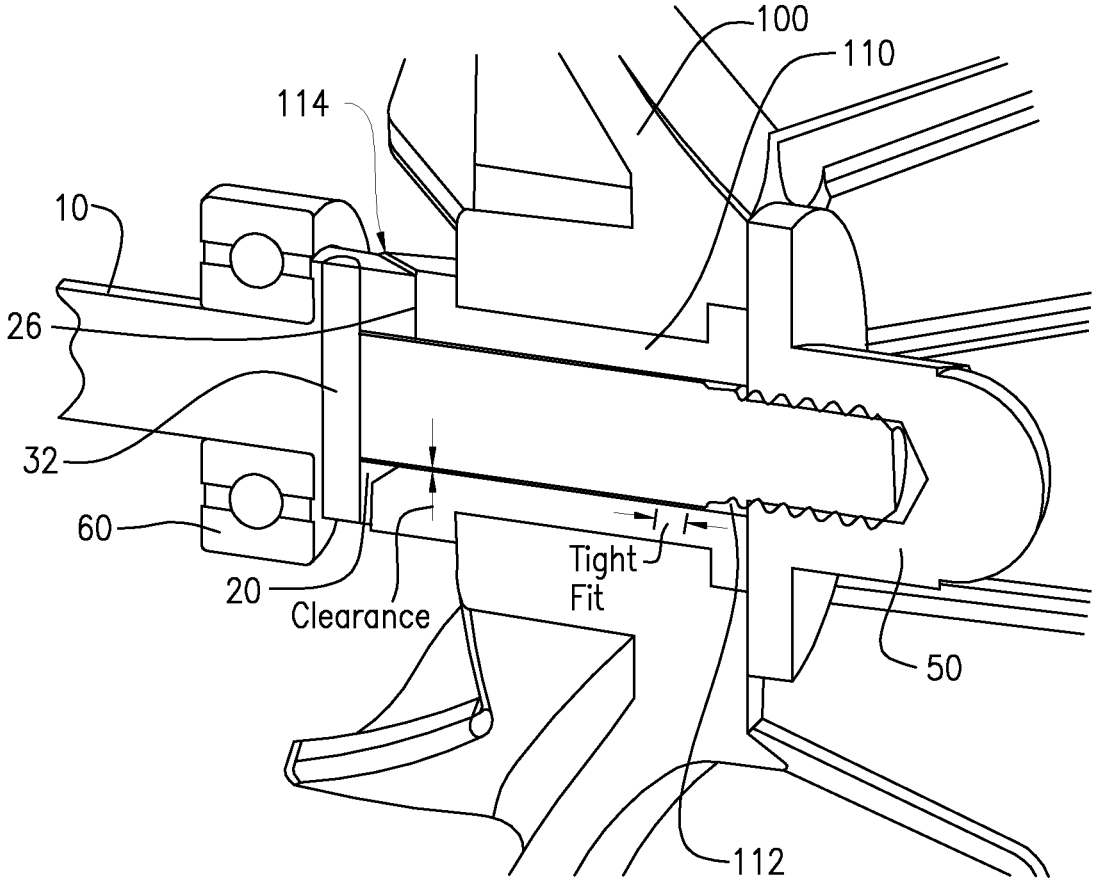
FIG. 4 is a cross-sectional view of an impeller and motor shaft assembly in accordance with one or more embodiments of the present invention.

With further reference to FIGS. 2-4, an impeller 100 includes a flange facing side 102 and an impeller hub 110 with x-axis defining hub groove 114 and y-axis defining hub groove 116 formed in a face thereof. Hub grooves 114 and 116 form structures complementary to the x-axis defining tongue 26 and y-axis defining tongue 28, respectively, so that when the impeller 100 is mounted via impeller hub bore 112 on the motor shaft 10 the grooves are coupled to the tongues of the flange 20. The grooves 114 and 116 each may have any suitable cross-sectional shape, such as a V-shape, U-shape, etc., as long as the cross-section is complementary to and creates an acceptable fit with the tongues 26 and 28. One skilled in the art will recognize the flange 20 may include a groove and a tongue, and the impeller hub 110 may have a corresponding complementary groove and tongue. Similarly, the flange 20 may include grooves and the impeller hub 110 may have corresponding complementary tongues.

In some cases the impeller 100 may be metal such as but not limited to magnesium, stainless steel, aluminum, etc. The hub impeller hub 110 may be of the same material or different, such as plastic, as is the case in some devices such as hand-held leaf blowers. A retaining nut 50 couples to the end 12 of the motor shaft 10. As the retaining nut 50 is secured, the tongue and groove coupling of the impeller hub 110 and flange 20 is brought into tight contact. As shown in FIG. 4 the x-axis defining hub groove 114 and the x-axis defining tongue 26 are in close contact. When journaled, there may be clearance between a portion of the motor shaft 10 and the impeller hub 110 in the impeller hub bore 112, however, in some embodiments a portion of the motor shaft 10 proximal the end 12 is in tight contact with the impeller hub 110. Motor bearing 60 bears against the flange 20 in the installed state. Subsequent removal and reattachment of the impeller 100 to the motor shaft 10 does not affect balance, because the tongue and groove assembly permits securement only in a single position, i.e., the original balanced position.

Figure 5A:
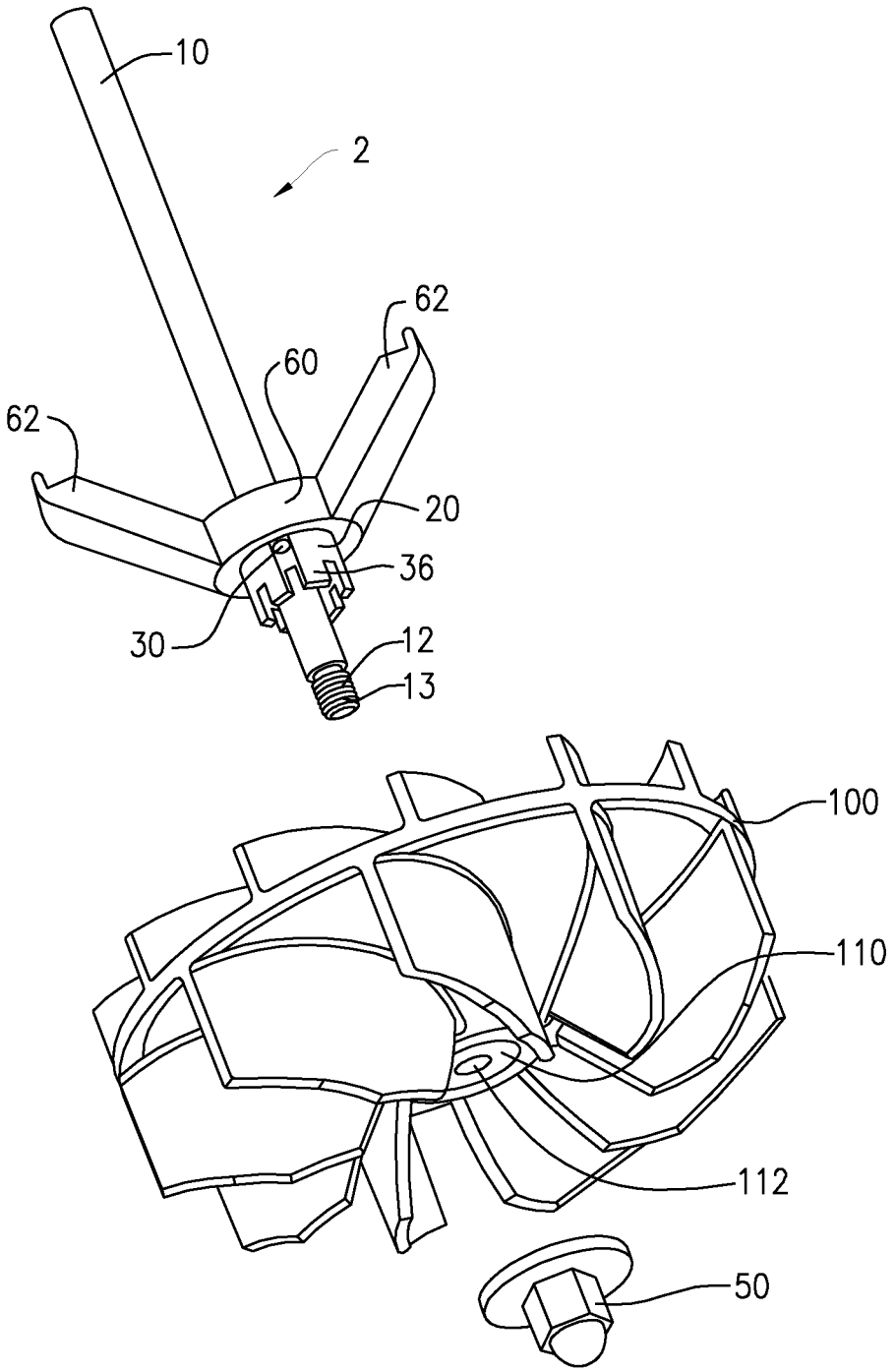
FIG. 5A is a front perspective view of an impeller and motor shaft assembly prior to installation of an impeller thereon in accordance with one or more embodiments of the present invention.
Figure 5B:
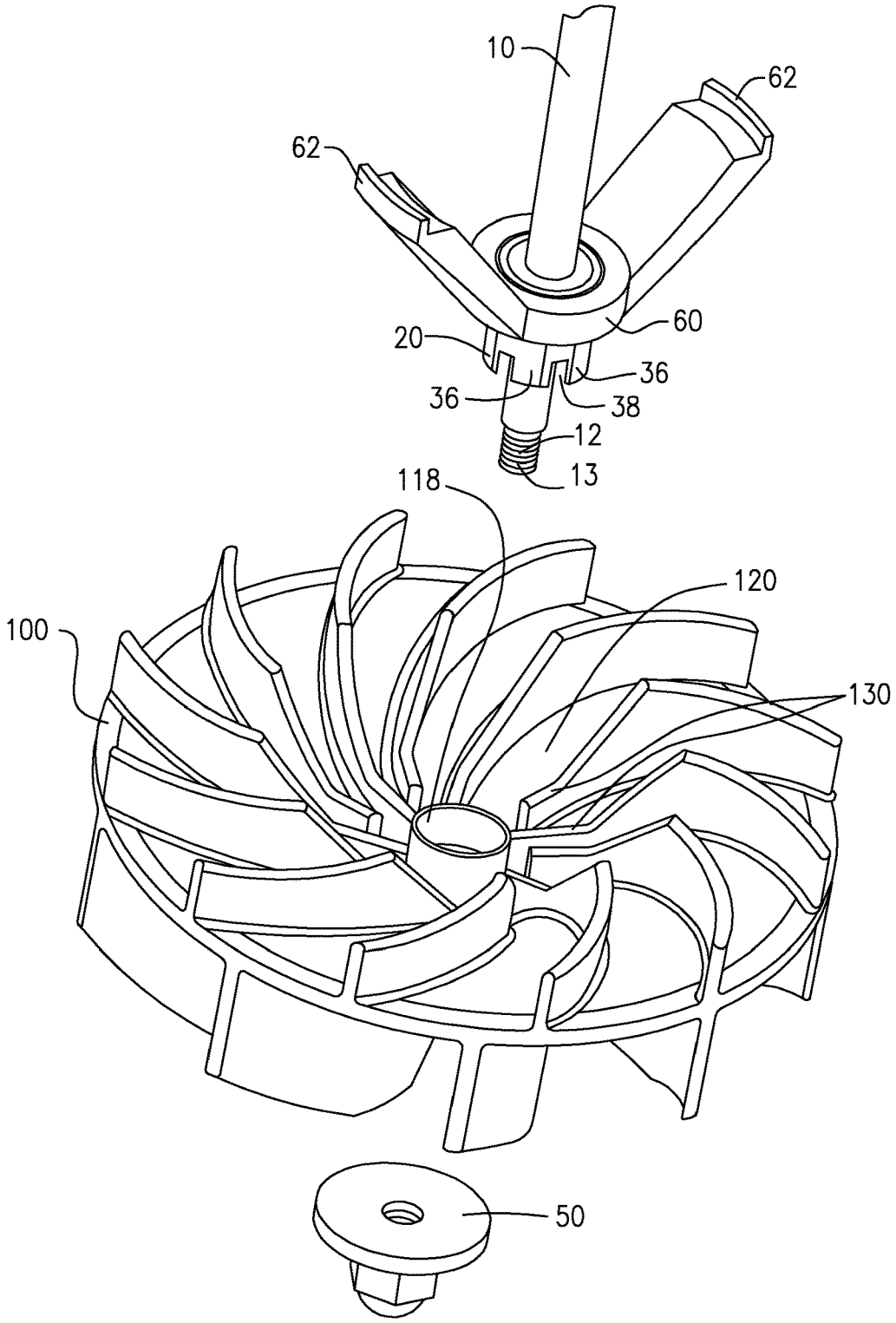
FIG. 5B is a rear perspective view of an impeller and motor shaft assembly prior to installation of an impeller thereon in accordance with one or more embodiments of the present invention.

Now referring to FIGS. 5A and 5B, in a further embodiment an impeller mounting assembly 2 includes a motor shaft 10 and a flange 20 coupled to the motor shaft 10. The motor shaft 20 is configured to be received in impeller hub bore 112. Nut 50 secures impeller 100 to motor shaft 10 at end 12 via threads 13. Nut 50 may be any suitable nut such as a flat nut, acorn nut, etc.

Figure 6A:
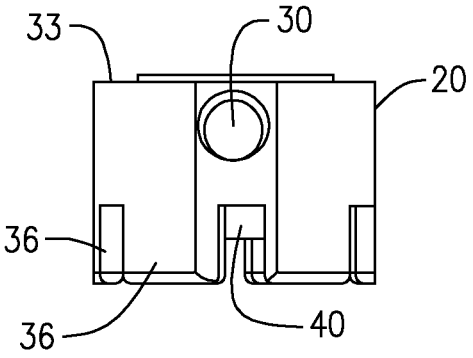
FIG. 6A is a side view of a flange in accordance with one or more embodiments of the present invention.
Figure 6B:
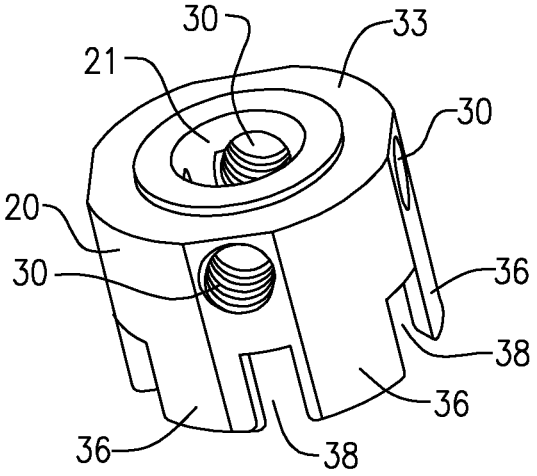
FIG. 6B is an elevated perspective view of a flange in accordance with one or more embodiments of the present invention.
Figure 6C:
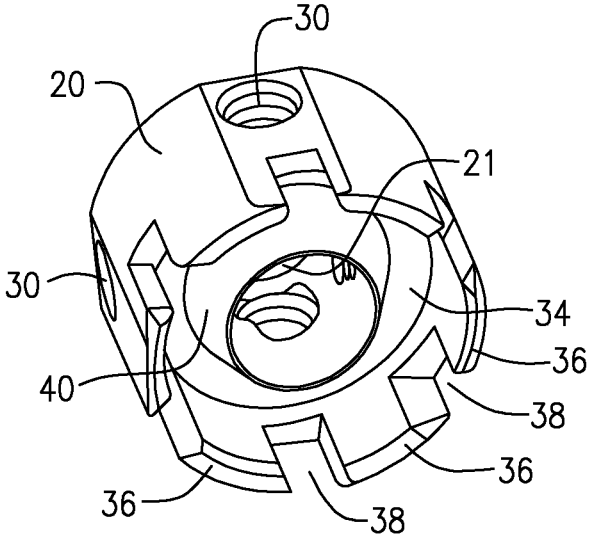
FIG. 6C is a bottom perspective view of a flange in accordance with one or more embodiments of the present invention.

With further reference to FIGS. 6A-6C, the flange 20 includes a flange facing end 33 and impeller facing end 34. A plurality of legs 36 disposed at the impeller facing end 34 of the flange 20 extend in axial alignment with the flange bore 21. The legs 36 may be positioned along a periphery of the flange 20. A plurality of notches 38 are formed between legs 36. As best seen in FIG. 5B, the legs 36 are configured to engage cavities 120 formed between impeller vane bases 130. The notches 38 are configured to engage vane bases 130.

The flange 20 includes at least one aperture 30 for receiving a fastener 32 such as a pin, set screw or the like. In one embodiment the flange includes four apertures 30 spaced 90° apart, each for accommodating a set screw 32. In such embodiments, a motor shaft 10 upon which the flange is to be mounted may include flats so that the set screw 32 has a flat surface to contact for optimal securement. Flange 20 further includes a flange centering element 40 for centralizing the impeller centroid to the turning axis. The flange centering element 40 extends from impeller facing end 34 and is positioned within the peripheral edge of flange 20 and is configured to mate with a corresponding complementary impeller hub centering element 118 (see FIGS. 7A, 8) formed in the impeller hub bore 112. In one embodiment the flange centering element 40 is a male frusto-conical element sized and dimensioned to couple with the impeller hub centering element 118, which is a corresponding female frusto-conical relief formed in the impeller hub 110. The flange centering element 40 may be concentric with the bore 21 of the flange 20.

The outer surface of the flange 20 may have any suitable shape, such as round, hexagonal, etc. to provide a working surface to manipulate the flange 20 onto the motor shaft 10 during assembly and disassembly. The flange 20 may be formed integrally with motor bearing 60 and motor bearing mounts 62.

Figure 7:
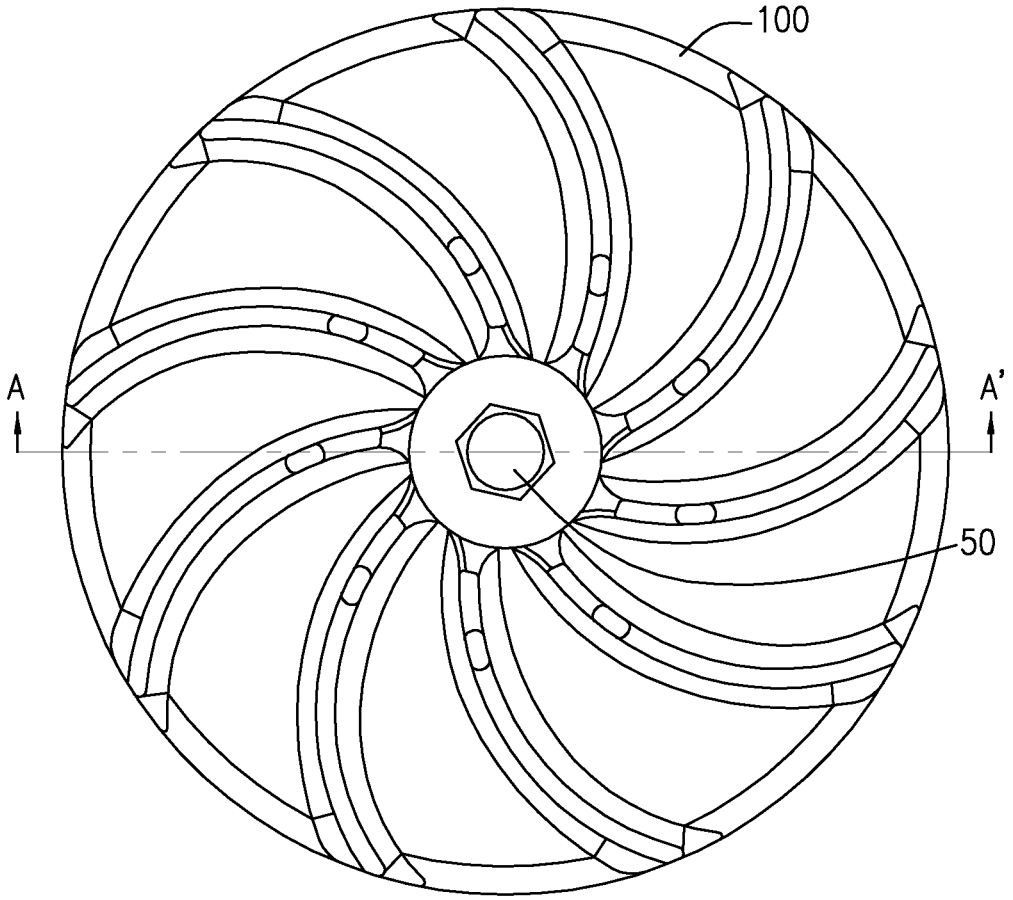
FIG. 7 is a top plan view of an impeller mounted to a motor shaft in accordance with one or more embodiments of the present invention.
Figure 7A:
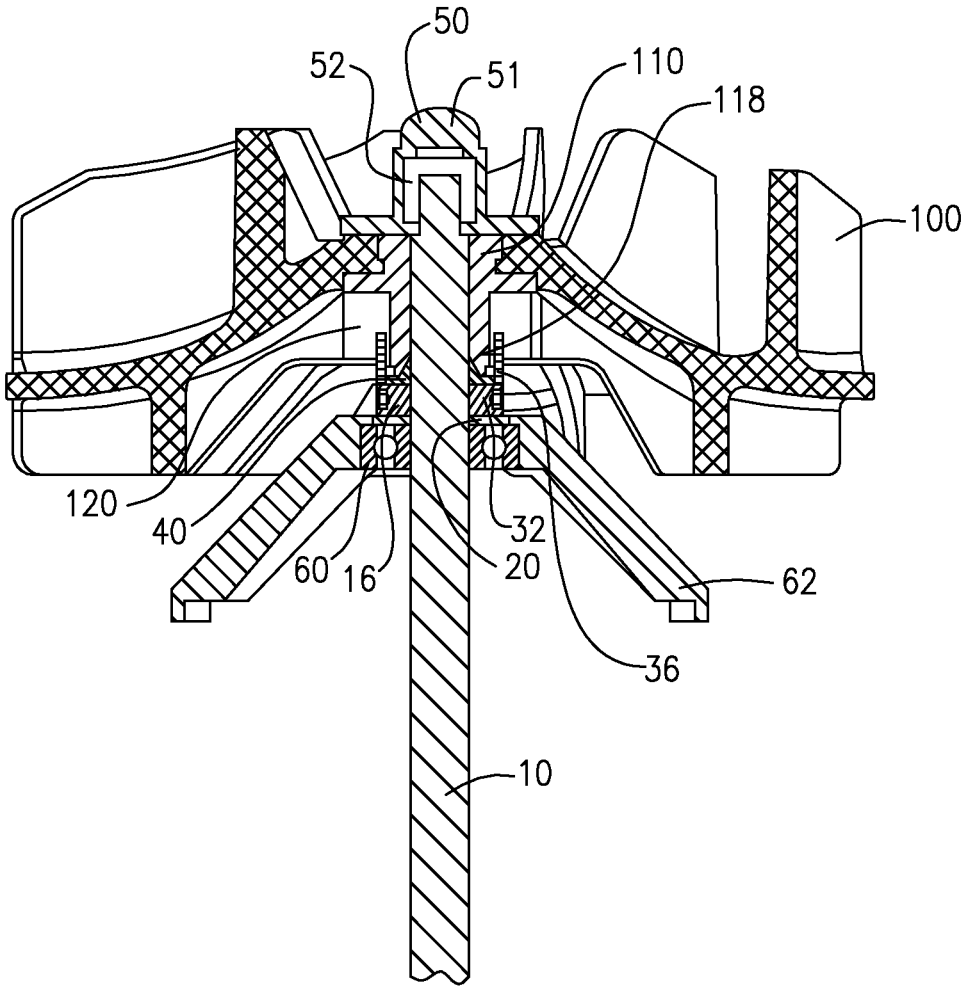
FIG. 7A is a cross-sectional view of the impeller mounted to a motor shaft of FIG. 7 taken along line A-A' in accordance with one or more embodiments of the present invention.
Figure 8:
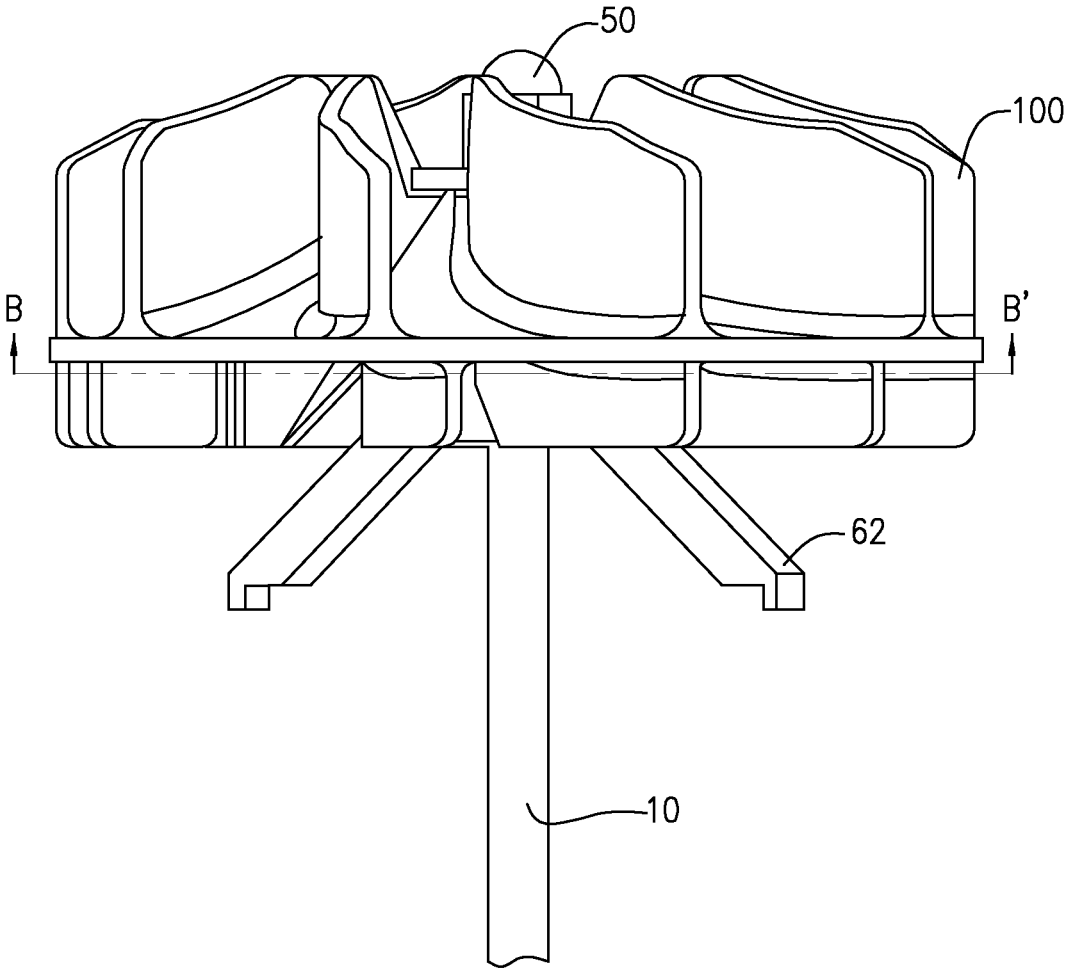
FIG. 8 is a side view of an impeller mounted to a motor shaft in accordance with one or more embodiments of the present invention.
Figure 8A:
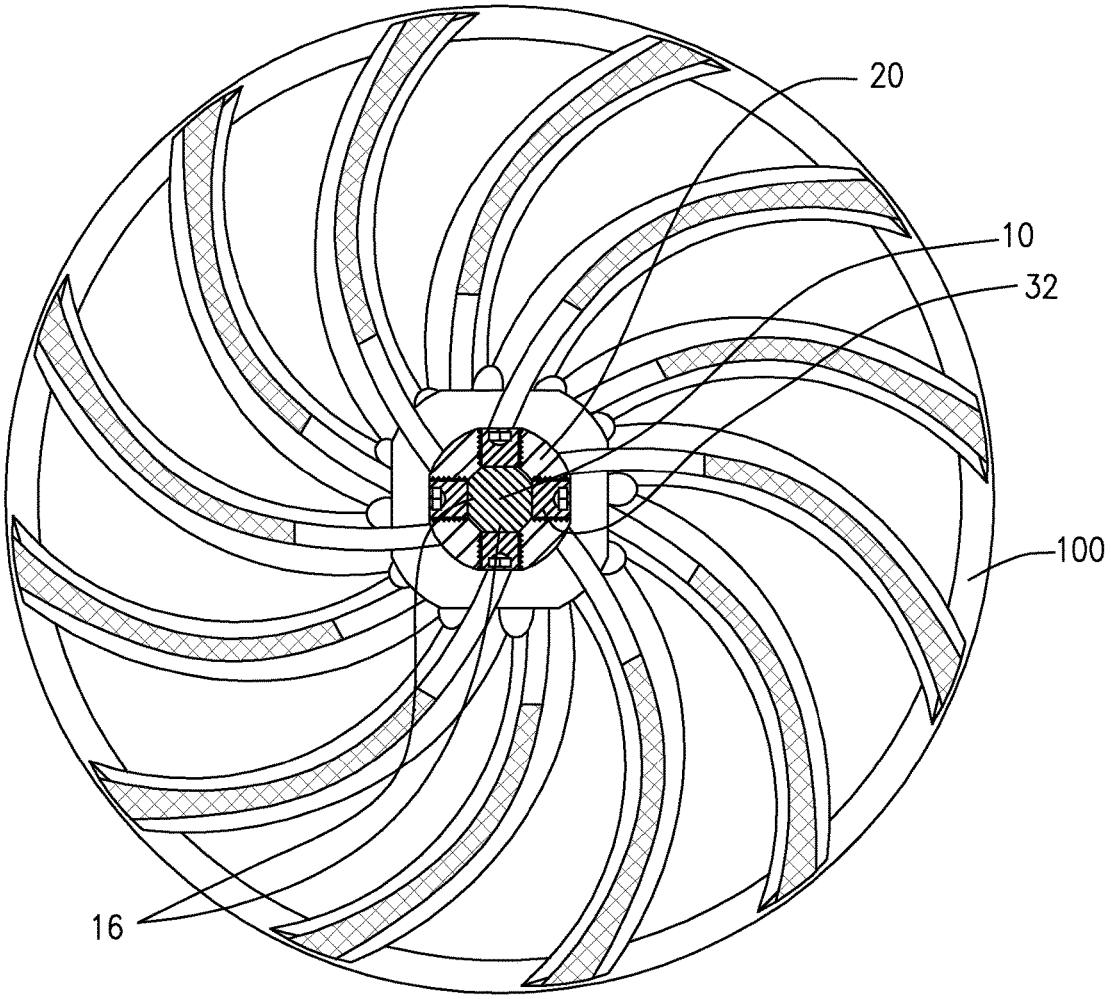
FIG. 8A is a cross-sectional view of the impeller mounted to a motor shaft of FIG. 8 taken along line B-B' in accordance with one or more embodiments of the present invention.

With further reference to FIGS. 7-8A, when the impeller 100 is mounted to the motor shaft 10, the flange centering element 40 is seated within the impeller hub 110 and snugly against the impeller hub centering element 118. The taper of the flange centering element 40 has an axis which exactly coincides with the cylindrical axis of the impeller 100 so that when the impeller hub centering element 118, with a matching female taper, is tightly assembled, the impeller assembly's centroid coincides with the motor turning axis. In one embodiment the taper is 20°. It will be apparent to those skilled in the art that other taper angles may be employed. In addition, the legs 36 of the flange 20 engage the cavities 120 formed between impeller vane bases 130, and the notches 38 accommodate the impeller vane bases. When journaled, there may be region of clearance between a portion of the motor shaft 10 and the impeller hub 100 in the impeller hub bore 112. As nut 50 is tightened on the motor shaft 10, pressure is exerted on the impeller hub 110 causing a close fit in the region of the motor shaft 10 proximal end 10 journaled in the impeller hub 110, while leaving clearance between the motor shaft 10 and the remainder of the impeller hub bore 112. Nut 50 may include a cover 51 and metal nut insert 52.

Set screws 32 retain the flange against the motor shaft 10. In some embodiments the motor shaft 10 includes flats 16 which are alignable with apertures 30 of flange 20, so that set screws 32 positioned in apertures 30 make contact with flats 16. In other embodiments, motor shaft 10 includes recesses with or without threads aligned with apertures 30 for receiving set screws or pins.

Practical Applications, Considerations and Methods

In practice, in preparation for achieving a low vibration blower assembly, the separate rotating parts are balanced. The following relates to the embodiment of the flange and assembly in which the flange includes a plurality of legs. For the sale of convenience, the embodiment of the flange with the plurality of legs is referred to as a "spider flange").

The motor rotor assembly, which includes the motor shaft 10 and spider flange 20, is a fixed assembly, and is two-plane dynamically balanced to a fine degree. The impeller assembly including the fixed molded-in hub is statically balanced to a fine degree. The securing nut, being small in diameter and light weight, can be assumed to be naturally manufactured, with enough symmetry, to have an acceptably low unbalance, without special balancing. These three elements are assembled to create the rotating parts of the blower.

It is an important feature of the blower, that as it is a hand held tool, the amount of vibration excited by the rotational unbalance must be low enough to be considered comfortable to hold. Vibration meters can be set to measure the velocity of the movement, and this is a good indication of the degree of discomfort any vibration might give. Usually the units are inches per second. Reasonable opinion has considered 0.3 inches per second as being comfortable for a delicate hand to hold. The blower definitely gets uncomfortable to use when the vibration exceeds 0.6 inches per second. It can be obviously said that the lower the vibration the better. For purposes of this disclosure the experimental goal is 0.25 inches per second measured by probing at a point on the blower housing near the rear of the handle. If the motor rotor by itself generated 0.1 inches per second vibration, it would be considered acceptable. If the impeller assembly generated by itself 0.2 inches per second it would be considered acceptable. The vibration from the nut would expected to be less than 0.05 inches per second.

If randomly assembled, the three elements together could have a maximum vibration of 0.35 inches per second. If carefully arranged and assembled to minimize vibration, the vibration could vary between a low of 0.05 inches per second, to a high of 0.15 inches per second. The nut's influence cannot be arranged as it is determined by the screw thread tightening angular position.

Based on the foregoing, it is possible to attain an average vibration of about 0.1 inches per second, if some extra time is spent on careful arrangement. As discussed hereinabove, location of the spider flange 20 on the impeller hub 110 is achieved by engaging the notches 38 of the spider flange 20 with the vane bases 130 of the hub 100. In one embodiment there are six of these notches 38 equally spaced around 360 degrees. This means that there are six possible orientations of the spider flange 20 and the impeller 100.

By assembling in each of the six orientations, and checking the vibration level, at full speed, of each orientation, an orientation which results in the minimum vibration can be discovered, and then used as the final assembly position. The shaft end 12 and the impeller hub 110 could then be marked to match this position so that after disassembly, this best position can be quickly reestablished.

An even more efficient method to determine the best position than trying all six possible positions includes the following steps:

1. Randomly assemble the impeller onto the motor shaft.
2. Run at full speed and note the vibration level.
3. Reassemble the impeller to the motor shaft by moving one position (60 degrees) clockwise.
4. Run at full speed and note the vibration level. The vibration will be either higher or lower.
5. Reassemble the impeller to the motor shaft by moving an addition position (60 degrees) clockwise.
6. Run at full speed and note vibration level. It can be read as a conclusion or a trend: (a) if the reading at step 6 is higher than at step 4, and the reading at step 4 was lower than step 2, then the reading at step 4 is the lowest and the assembly position at step 4 is the best; (b) if the reading at step 6 is lower than at step 4 and the reading at step 4 was higher than at step 2, then the reading at step 4 is the highest and the position at 180 degrees from this position is the best; (c) if the reading at step 6 is higher than at step 4 and the reading at step 4 was higher than step 2, then one more reassembly step 7 and testing step 8 must be done; (d) if the reading at step 6 is lower than at step 4 and the reading at step 4 was lower than at step 2, then one more reassembly step 7 and testing step 8 must be done.
7. Reassemble the impeller to the motor shaft by moving an additional position (60 degrees) clockwise.
8. Run at full speed and note the vibration level. It can be read as a conclusion: (e) if the reading at step 8 is higher than at step 6 (c) then the reading at step 2 is the lowest and the assembly position at step 2 is the best; (f) if the reading at step 8 is higher than at step 6 (d) then the reading at step 6 is the lowest and the assembly position at step 6 is the best; (g) if the reading at step 8 is lower than at step 6 (c) then the reading at step 6 is the highest and the assembly position 180 degrees from step 6 is the best; (h) if the reading at step 8 is lower than at step 6 (d) then the reading at step 8 is the lowest and the assembly position at step 8 is the best.

With this more efficient method the best assembly position can be determined in three tests for 33% of the cases, and the remainder being determined in four tests. In the search for a method to consistently achieve excellent low vibration running, this selective assembly method can be an important contribution as it can be done with little cost.

Although the devices and systems of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention.

What is claimed is:

1. A flange for centering an impeller on a motor shaft, the flange comprising a central bore for receiving a motor shaft, an impeller facing end and a motor bearing facing end formed opposite the impeller facing end, wherein the impeller facing end comprises at least one impeller engaging element configured to couple with a flange facing side of the impeller, wherein the flange facing side of the impeller comprises at least one flange engaging element complementary to the at least one impeller engaging element of the flange, wherein the at least one impeller engaging element comprises at least two tongues configured to couple with corresponding complementary grooves formed on a flange facing end of an impeller hub, wherein one of the at least two tongues comprises an x-axis defining tongue and at least one of the at least two tongues comprises a y-axis defining tongue.

2. A flange for centering an impeller on a motor shaft, the flange comprising a central bore for receiving a motor shaft, an impeller facing end and a motor bearing facing end formed opposite the impeller facing end, wherein the impeller facing end comprises at least one impeller engaging element configured to couple with a flange facing side of the impeller, wherein the flange facing side of the impeller comprises at least one flange engaging element complementary to the at least one impeller engaging element of the flange, wherein the at least one impeller engaging element comprises at least two grooves configured to couple with corresponding complementary tongues formed on a flange facing end of an impeller hub, wherein one of the at least two grooves comprises an x-axis defining groove and at least one of the at least two grooves comprises a y-axis defining groove.

3. A flange for centering an impeller on a motor shaft, the flange comprising a central bore for receiving a motor shaft, an impeller facing end and a motor bearing facing end formed opposite the impeller facing end, wherein the impeller facing end comprises at least one impeller engaging element configured to couple with a flange facing side of the impeller, wherein the flange facing side of the impeller comprises at least one flange engaging element complementary to the at least one impeller engaging element of the flange, wherein the at least one impeller engaging element comprises a plurality of legs extending from the impeller facing end, wherein each of the plurality of legs is configured to engage a cavity formed in the flange facing side of an impeller.

4. The flange of claim 3 further comprising a notch formed between each of the plurality of legs, wherein each of the notches is configured to accommodate a vane base extending from the flange facing side of the impeller.

5. The flange of claim 3 wherein the at least one impeller engaging element further comprises a flange centering element extending from the impeller facing side of the flange and positioned within a peripheral edge of the flange and within a periphery formed by the legs, wherein the flange centering element is configured to engage an impeller centering element positioned in a hub of the impeller, wherein the impeller centering element has a cross-section complementary to a cross-section of the flange centering element.

6. A flange for centering an impeller on a motor shaft, the flange comprising a central bore for receiving a motor shaft, an impeller facing end and a motor bearing facing end formed opposite the impeller facing end, wherein the impeller facing end comprises at least one impeller engaging element configured to couple with a flange facing side of the impeller, wherein the flange facing side of the impeller comprises at least one flange engaging element complementary to the at least one impeller engaging element of the flange, wherein the at least one impeller engaging element comprises a flange centering element extending from the impeller facing side of the flange and positioned within a peripheral edge of the flange, wherein the flange centering element is configured to engage an impeller centering element positioned in a hub of the impeller, wherein the impeller centering element has a cross-section complementary to a cross-section of the flange centering element.

7. The flange of claim 6 wherein the flange centering element comprises a frusto-conical protrusion and the impeller centering element comprises a frusto-conical relief formed in a bore of an impeller hub.

8. An assembly for centering an impeller on a motor shaft, the assembly comprising a motor shaft and a flange, wherein the flange is mounted on the motor shaft via a central bore formed in the flange, the flange comprising an impeller facing end and a motor bearing facing end formed opposite the impeller facing end, wherein the impeller facing end comprises at least one impeller engaging element configured to couple with a flange facing end of an impeller, wherein the flange facing end of the impeller comprises at least one flange engaging element complementary to the at least one impeller engaging element of the flange, wherein the at least one impeller engaging element comprises at least two tongues configured to couple with corresponding complementary grooves formed on a flange facing end of an impeller hub wherein one of the at least two tongues comprises an x-axis defining tongue and at least one of the at least two tongues comprises a y-axis defining tongue.

9. An assembly for centering an impeller on a motor shaft, the assembly comprising a motor shaft and a flange, wherein the flange is mounted on the motor shaft via a central bore formed in the flange, the flange comprising an impeller facing end and a motor bearing facing end formed opposite the impeller facing end, wherein the impeller facing end comprises at least one impeller engaging element configured to couple with a flange facing end of an impeller, wherein the flange facing end of the impeller comprises at least one flange engaging element complementary to the at least one impeller engaging element of the flange, wherein the at least one impeller engaging element comprises at least two grooves configured to couple with corresponding complementary tongues formed on a flange facing end of an impeller hub wherein one of the at least two grooves comprises an x-axis defining groove and at least one of the at least two grooves comprises a y-axis defining groove.

10. An assembly for centering an impeller on a motor shaft, the assembly comprising a motor shaft and a flange, wherein the flange is mounted on the motor shaft via a central bore formed in the flange, the flange comprising an impeller facing end and a motor bearing facing end formed opposite the impeller facing end, wherein the impeller facing end comprises at least one impeller engaging element configured to couple with a flange facing end of an impeller, wherein the flange facing end of the impeller comprises at least one flange engaging element complementary to the at least one impeller engaging element of the flange wherein the at least one impeller engaging element comprises a plurality of legs extending from the impeller facing end, wherein each of the plurality of legs is configured to engage a cavity formed in the flange facing side of an impeller.

11. The assembly of claim 10 further comprising a notch formed between each of the plurality of legs, wherein each of the notches is configured to accommodate a vane base extending from the flange facing side of the impeller.

12. The assembly of claim 10 wherein the at least one impeller engaging element further comprises a flange centering element extending from the impeller facing side of the flange and positioned within a peripheral edge of the flange and within a periphery formed by the legs, wherein the flange centering element is configured to engage an impeller centering element positioned in a hub of the impeller, wherein the impeller centering element has a cross-section complementary to a cross-section of the flange centering element.

13. The assembly of claim 11 wherein the flange centering element comprises a frusto-conical protrusion and the impeller centering element comprises a frusto-conical relief formed in a bore of an impeller hub.

14. An assembly for centering an impeller on a motor shaft, the assembly comprising a motor shaft and a flange, wherein the flange is mounted on the motor shaft via a central bore formed in the flange, the flange comprising an impeller facing end and a motor bearing facing end formed opposite the impeller facing end, wherein the impeller facing end comprises at least one impeller engaging element configured to couple with a flange facing end of an impeller, wherein the flange facing end of the impeller comprises at least one flange engaging element complementary to the at least one impeller engaging element of the flange wherein the at least one impeller engaging element comprises a flange centering element extending from the impeller facing side of the flange and positioned within a peripheral edge of the flange, wherein the flange centering element is configured to engage an impeller centering element positioned in a hub of the impeller, wherein the impeller centering element has a cross-section complementary to a cross-section of the flange centering element.

* * * * *